US009277805B2

(12) United States Patent
Baker et al.

(10) Patent No.: US 9,277,805 B2
(45) Date of Patent: Mar. 8, 2016

(54) BRUSH CARE SYSTEM

(71) Applicants: Diane A. Baker, Berkeley, CA (US); Malcolm D. Plant, Berkeley, CA (US)

(72) Inventors: Diane A. Baker, Berkeley, CA (US); Malcolm D. Plant, Berkeley, CA (US)

( * ) Notice: Subject to any disclaimer, the term of this patent is extended or adjusted under 35 U.S.C. 154(b) by 80 days.

(21) Appl. No.: 14/161,600

(22) Filed: Jan. 22, 2014

(65) Prior Publication Data

US 2014/0189969 A1 Jul. 10, 2014

Related U.S. Application Data

(62) Division of application No. 12/961,488, filed on Dec. 6, 2010, now abandoned.

(60) Provisional application No. 61/266,993, filed on Dec. 4, 2009.

(51) Int. Cl.
*A46B 17/06* (2006.01)

(52) U.S. Cl.
CPC ..... *A46B 17/06* (2013.01); *A46B 2200/202* (2013.01)

(58) Field of Classification Search
CPC ..... A46B 2200/202
See application file for complete search history.

(56) References Cited

U.S. PATENT DOCUMENTS

| | | | | |
|---|---|---|---|---|
| 3,955,670 | A | 5/1976 | Buslik | |
| 4,865,282 | A | 9/1989 | Yonkman | |
| 5,687,444 | A | 11/1997 | Hakker | |
| 7,007,797 | B1 * | 3/2006 | Ruccolo | B44D 3/125 206/15.2 |
| 2004/0261819 | A1 * | 12/2004 | Farnoush | A46B 17/06 134/6 |

FOREIGN PATENT DOCUMENTS

| | | |
|---|---|---|
| EP | 0379294 | 7/1990 |
| WO | 94/10875 | 5/1994 |

OTHER PUBLICATIONS

PCT Application PCT/IB2010/003444, International Preliminary Report on Patentability, May 6, 2012.

* cited by examiner

*Primary Examiner* — Jason Ko
(74) *Attorney, Agent, or Firm* — Brian Beverly; Beeson Skinner Beverly, LLP

(57) ABSTRACT

A brush care system for cleaning and drying brushes used in cosmetic or fine art painting applications comprises a washing vessel and a drying vessel. The washing vessel includes a cleaner having a cleaning surface against which the bristles of a brush can be agitated for cleaning. The washing vessel and the drying vessel can be secured together for convenient storage and to enclose and store the cleaner. The drying vessel functions as a stand for drying cleaned brushes and includes walls having one or more apertures for ventilating the vessel. The washing vessel may include one or more partitions.

17 Claims, 3 Drawing Sheets

BRUSH CARE SYSTEM

CROSS-REFERENCE TO RELATED APPLICATIONS

This application is a divisional application of application Ser. No. 12/961,488, filed Dec. 6, 2010, which claims the benefit of U.S. Provisional Application No. 61/266,993, filed Dec. 4, 2009. This application is related to U.S. Pat. No. 7,140,061 which is incorporated herein by reference in its entirety.

BACKGROUND OF THE INVENTION

Brushes for cosmetics and fine arts applications require regular care. Dirty cosmetics brushes can cause skin irritation or infection and can carry impurities to the face and back into the cosmetic product. Improper care of paint brushes will cause rapid deterioration, necessitating replacement. Good quality brushes are expensive, so brush preservation is prudent.

SUMMARY OF THE INVENTION

A brush care system is provided that has two parts which can be secured together for convenient storage. One part is a washing vessel that accommodates a tablet of soap or other cleaning materials in a bottom portion. Tablet herein refers to a compacted form, such as a bar of soap, and is not meant to define a specific shape. Water can be added to moisten or immerse the soap, while a cleaning screen retains the soap and allows a brush to be rubbed on the soap through the cleaning screen. A cleaning surface allows for gentle agitation of the brush bristles to more efficiently remove paint, dirt, cosmetics, and other material from the brush bristles. The cleaning surface may be permeable to allow water or other fluid to be drained off while retaining the soap. The washing vessel may be configured with more than one partition.

A second part of the system is a drying vessel that functions as a stand for drying brushes that have just been cleaned. The drying vessel includes one or more apertures to encourage air circulation around brushes held within the vessel. The bottom of the drying vessel may be impermeable so that a lower portion of the drying vessel may hold clean water for rinsing.

DETAILED DESCRIPTION OF THE ILLUSTRATED EMBODIMENT

Figure 1:
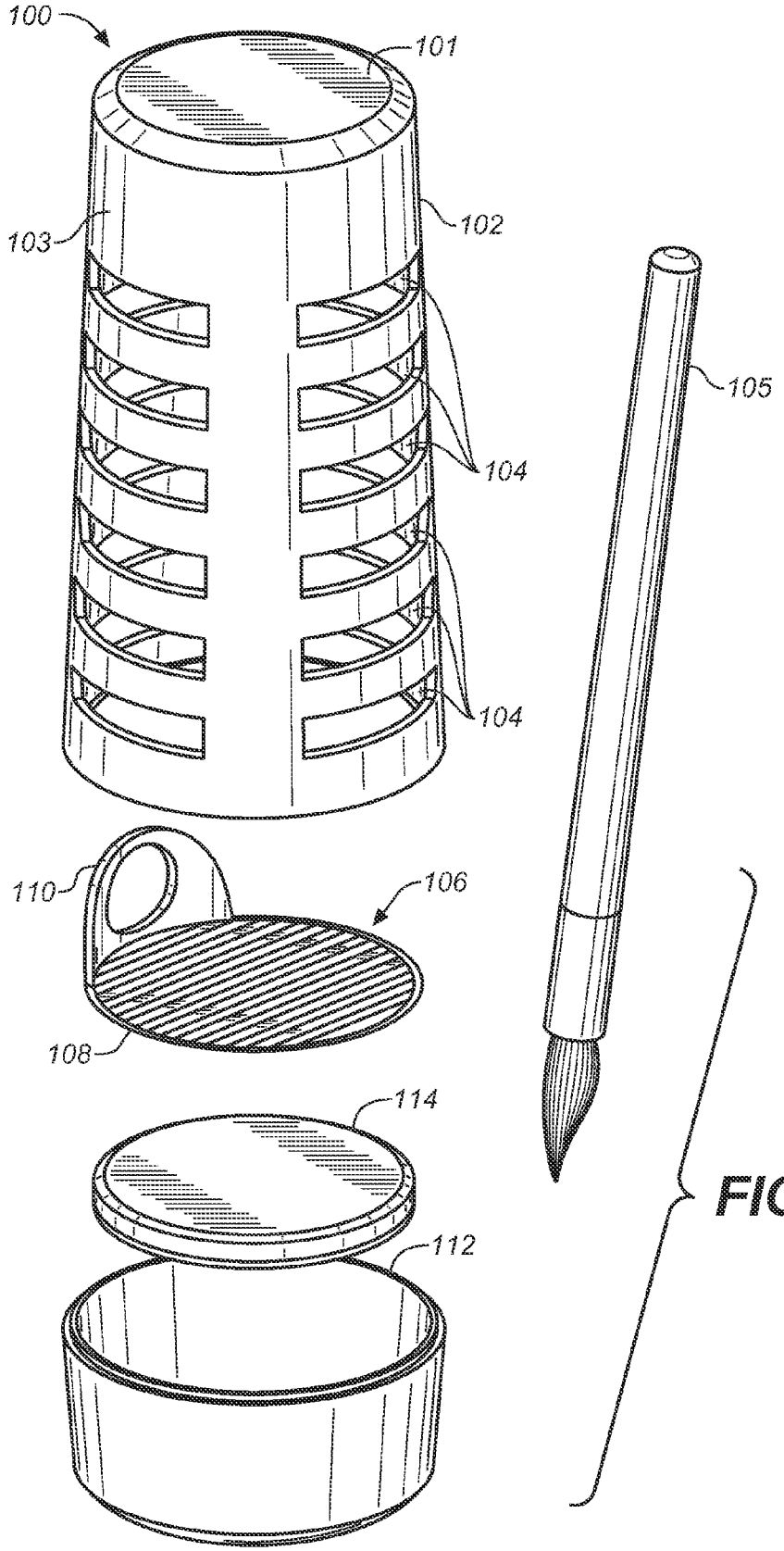
FIG. 1 is an exploded upper perspective view of a brush care system according to the invention.

A brush care system 100 includes a drying vessel 102 including a bottom 101 and an upstanding wall or walls 103 having apertures 104, a brush 105, a brush cleaner 106, and a washing vessel 112, as shown in FIG. 1. FIG. 1 also shows a surfactant tablet 114 for use with an embodiment of the present system. In one embodiment, all components except for surfactant tablet 114 are manufactured from plastic. In alternative embodiments, the relevant components can be manufactured from ceramic, glass, or any materials that enable functionality. The system is configured to be lightweight and portable. It is particularly contemplated that the system be sized to accommodate brushes of varying sizes and shapes.

In one embodiment, apertures may be provided in the bottom 101 of the drying vessel 102 for better ventilation when drying brushes. In another embodiment, the bottom 101 of the drying vessel 102 may be impermeable so clean water can be held in the lower portion 204 for rinsing the brushes, as shown in FIG. 2.

Figure 2:
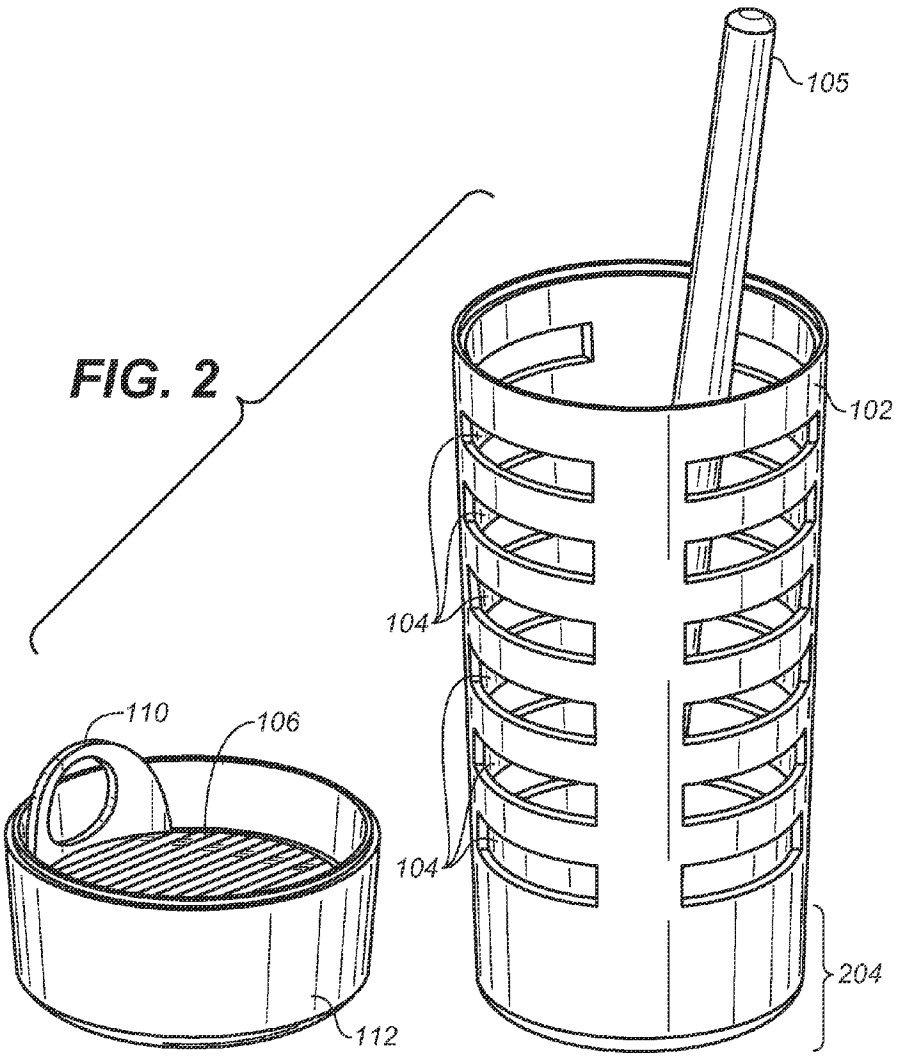
FIG. 2 is an upper perspective view thereof showing the brush care system in a typical configuration during use with a brush in the drying vessel.

FIG. 2 shows a system in accordance with an embodiment of the present invention in use with a brush 202. Washing vessel 112 holds water and a surfactant tablet 114, such as a tablet of soap, compressed detergent, or other solid cleaner. Brush cleaner 106 is positioned inside the washing vessel 112 with cleaning surface 108 resting atop the surfactant tablet 114. The water level in washing vessel 112 can be above or below the level of cleaning surface 108. In alternative embodiments, washing vessel 112 can hold plain water or another cleaning liquid, such as a chemical cleaner, or can hold a solution as for example detergent powder, detergent liquid, or liquid, powder, or solid soap in water. A removal handle 110 which extends upwardly from cleaning surface 108 allows for easy removal from and replacement of brush cleaner 106 in washing vessel 112.

In one embodiment, the invention provides a dynamic cleaning system in which brush cleaner 106 rests atop surfactant tablet 114. The level of brush cleaner 106 drops within washing vessel 112 over time as surfactant tablet 114 dissolves. In many uses, tablet 114 is a cake of soap or other soluble cleaning material, and the level of cleaner 106 will lower very gradually as tablet 114 dissolves with repeated use, so long as washing vessel 112 is drained of water after each use.

The system is hygienic because it provides for air-drying and air circulation which minimizes pollutants which are more easily transferred when using drying cloths. The washing vessel also enables proper disposal of cleaning materials and cleaned detritus.

In normal use of the system, the bristles of a brush are scraped, rubbed, or agitated against cleaning surface 108 to remove impurities, such as cosmetics, detritus, or paint. A representative brush showing bristles or other brush fibers is depicted in U.S. Pat. No. 7,140,061. Other brushes and bristle and fiber configurations are well known to those skilled in the art and are contemplated within the scope of the invention. Brush bristles are meant to refer to longitudinal hairs or bristles that extend from an elongated handle.

In one embodiment the cleaning surface 108 comprises a grid of rectilinear apertures. In alternate embodiments the cleaning surface comprises a combination of spaces and protrusions forming a rough or differentiated surface that is effective for agitating the bristles of a brush being cleaned.

Different configurations of apertures are provided for within the scope of the invention. Two different kinds of apertures are possible which could be roughly characterized as asymmetric or symmetric. To distinguish the two, consider any aperture with respect to arbitrarily oriented perpendicular axes x and y within the plane of the (substantially flat) screen. Any aperture has a unique minimally enclosing rectangle with sides parallel to those axes. Consider the x dimension and the y dimension of that rectangle. If the ratio of these dimensions is outside of the range [4:9], the aperture shall be defined as asymmetric. For example, apertures formed as the gaps between parallel wires connecting two sides of a square aperture defined in the cleaner (screen or grid) would generally be asymmetric. If an aperture's ratio of x and y dimensions falls within the ratio [4:9], the aperture shall be defined as symmetric. For example, roughly square apertures formed by a fine grid of parallel wire pieces with similar x and y pitch, would be symmetric. It will be understood that the apparatus can include a combination of different apertures, including both symmetric and asymmetric apertures. The scope of the present invention encompasses both symmetric and asymmetric apertures as herein defined.

Clean water can be retained in a water-retaining portion 204 of drying vessel 102 for rinsing. Then the clean water can be emptied and the user can place the brush in the stand bristles down, for drying. In an alternative embodiment, a notch or retainer is provided in drying vessel 102 for retaining brush 202 in an upright position. Apertures 104 ventilate the drying vessel to more effectively circulate air around drying brushes supported within the vessel. Before placing a brush bristles down, a user preferably places a protective sleeve or other covering over the bristles. One example of such a protective sleeve is described in U.S. Pat. No. 7,140,061 to Baker et al. In alternative embodiments, other covers, sleeves, or cups can be placed over the bristles before the brush is placed bristles-down in the drying vessel.

Figure 3A:
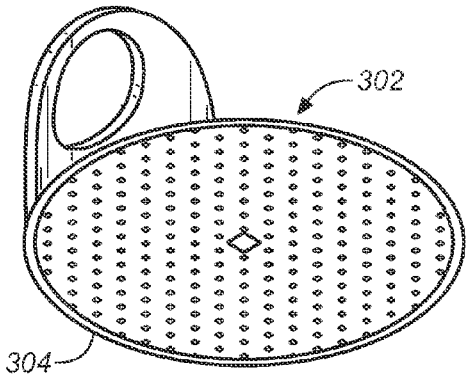
FIGS. 3A-3B are upper perspective views of alternative embodiments of cleaning screens.
Figure 3B:
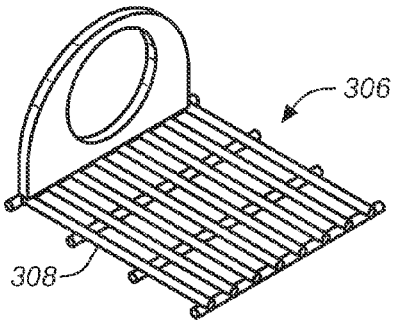

FIGS. 3A and 3B show alternative embodiments 302 and 306 of the cleaner showing a cleaning surface 304 having apertures and a square slotted grid 308. In the illustrated embodiments, cleaning surface 108 is generally shaped like a flat disk with parallel apertures and bars in order to provide an irregular surface against which to agitate the brush bristles. In alternative embodiments the brush cleaner need not be a circle; it can be any shape that fits into the washing vessel, such as a half circle, triangle, or square. The rough surface on the brush cleaner can be provided by square, rectangle, or triangle apertures (as, for example, in a screen), by round holes, or even by bumps or protrusions on the upper surface of the cleaner. In alternative embodiments, a blotting cloth may be provided.

Figure 4:
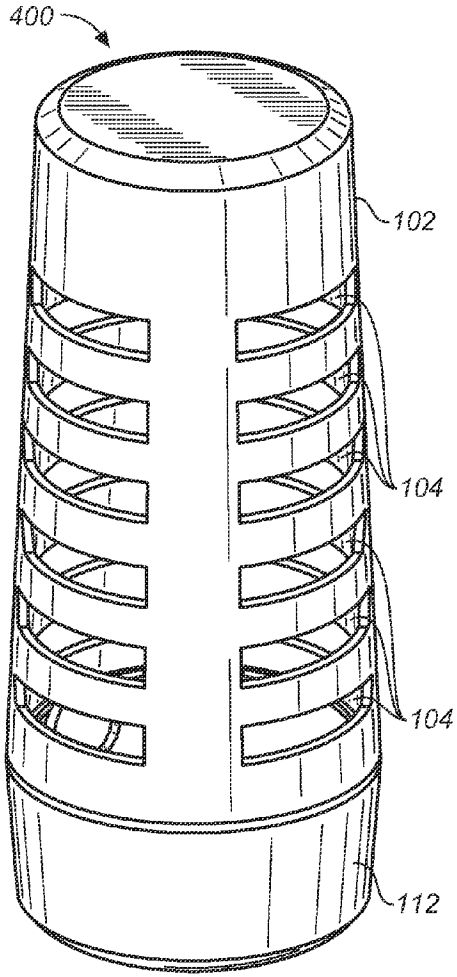
FIG. 4 is an upper perspective view of the brush care system shown in FIG. 1 with the washing vessel and drying vessel attached together to form an assembly.

FIG. 4 shows an assembled drying, cleaning and washing apparatus 400. In a preferred embodiment, drying vessel 102 snaps securely into washing vessel 112. In other alternatives, drying vessel 102 and washing vessel 112 can be threaded so as to screw together, or can attach by any known means that preserves functionality. In either alternative, brush cleaner 106 resides inside the assembled apparatus.

In one embodiment, the washing vessel 112 is configured as having one receptacle for liquid or cleaner, as shown in FIG. 1. The one and only receptacle is the entire interior of the washing vessel.

In other embodiments, it is possible to have more than one receptacle in the washing vessel 112, which can be defined by a partition or an enclosure or separated area in the washing vessel. The advantage is to individually contain more than one kind of water, liquid or solution in one washing vessel. One partition may contain a solution for cleaning while another may contain clean water for rinsing. When there are two or more receptacles, the receptacles may or may not have the same shape as the washing vessel. In one embodiment, a washing vessel is round and includes two partitions configured as two half circles. In one embodiment, a round washing vessel with plural receptacles may be configured as two circles with different diameters that are concentric or non-concentric. Partitions are enabled by a divider or dividers which are no higher than the washing vessel. The dividers may be made of the same material as the washing vessel. With larger systems for plural brushes, more receptacles may be needed.

Figure 5A:
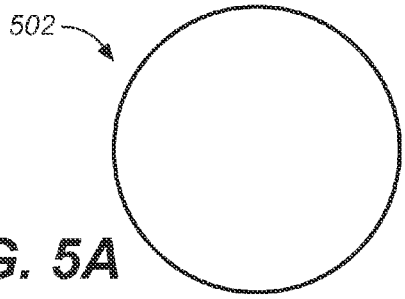
FIGS. 5A-5D are plan views of several embodiments of a washing vessel.
Figure 5B:
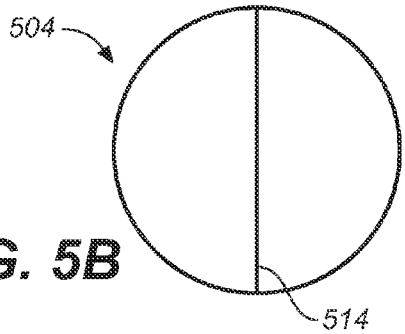
Figure 5C:
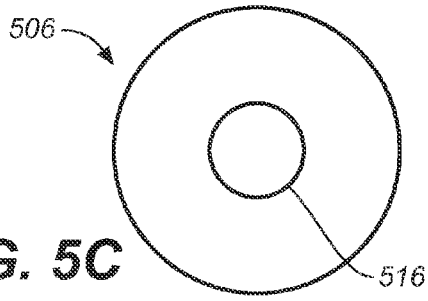
Figure 5D:
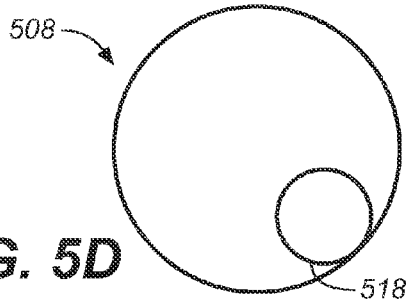

FIGS. 5A-5D show top views of the washing vessel 112 with one or two partitions. FIG. 5A shows washing vessel 502 with only one receptacle. FIG. 5B shows washing vessel 514 with two semi-circular partitions defined by divider 514. FIG. 5C shows washing vessel 506 with partitions forming two concentric circles defined by divider 516. FIG. 5D shows washing vessel 508 with partitions in the form of two non-concentric circles defined by divider 518.

Various embodiments of a brush care system have been described above. It will, however, be understood that various modifications and changes may be made without departing from the broader spirit and scope of the present invention as set forth in the claims that follow. The specification and drawings are accordingly to be regarded in an illustrative rather than restrictive sense. These and other variations upon and modifications to the illustrated embodiments are provided for by the present invention, the scope of which is defined by the following claims.

We claim:

1. A brush care system comprising:

a washing vessel having one or more liquid-holding compartments for washing brushes, said one or more compartments including an irregular brush cleaning surface against which a brush may be agitated for cleaning, and a drying vessel for retaining drying brushes, said drying vessel including one or more upstanding walls having one or more apertures for ventilating said drying vessel, said drying vessel removably securable to said washing vessel;

and a surfactant tablet disposed in said washing vessel, wherein said cleaning surface is supported on said surfactant tablet.

2. The brush care system of claim 1 wherein:

said irregular surface includes an array of apertures.

3. The brush care system of claim 1 wherein:

said irregular cleaning surface is substantially planar and has an array of protrusions.

4. The brush care system of claim 1 wherein:

said washing vessel has an upper edge, said drying vessel has an upper rim, and the upper rim of said drying vessel is detachably securable to the upper edge of said washing vessel forming an assembly.

5. The brush care system of claim 4 wherein:

said cleaning surface is disposed in said assembly.

6. The brush care system of claim 1 wherein:

said cleaning surface is removably disposed in said washing vessel.

7. The brush care system of claim 6 wherein:

said cleaning surface is removably disposed in one of the one or more compartments of said washing vessel.

8. The brush care system of claim 7 further comprising:

a removal handle extending from said cleaning surface to facilitate removal of said cleaning surface from one of said one or more compartments.

9. The brush care system of claim 8 wherein:

said one of said one or more compartments includes an upstanding sidewall, and said removal handle has an cross-section conforming to and disposed adjacent said sidewall.

10. The brush care system of claim 1 wherein:

said supported cleaning surface has an elevation within said washing cup, said surfactant tablet dissolves with use, and the elevation of said brush cleaner lowers as said surfactant tablet dissolves.

11. The brush care system of claim 1 wherein:

at least one of the one or more compartments of said washing vessel includes a floor comprised of said irregular cleaning surface.

12. The brush care system of claim 1 wherein:

brushes are retained with their bristles pointed down in said drying glass while drying.

13. The brush care system of claim 1 further comprising:

one or more brushes each having bristles extending axially from an elongated handle, and one or more protective sleeves enveloping the bristles of said brushes such that when said brushes are placed with their bristles down in said drying vessel for drying said bristles of each brush remain in substantially axial alignment with said brush handle.

14. The brush care system of claim 1 wherein:

the one or more apertures of said drying vessel is vertically arranged over more than half of the height of one of the one or more upstanding walls of said drying vessel.

15. The brush care system of claim 1 wherein:

said drying vessel includes a liquid-retaining bottom portion.

16. A brush care system comprising:

a washing vessel having one or more liquid-holding compartments and an upper edge, said one or more liquid-holding compartments for washing brushes, said one or more compartments including a cleaning surface against which a brush may be agitated for cleaning, and a drying vessel for retaining drying brushes, said drying vessel having an upper rim and one or more upstanding walls, said one or more upstanding walls including one or more apertures for ventilating said drying vessel, and the upper rim of said drying vessel detachably secured to the upper edge of said washing vessel to form an assembly;

and a surfactant tablet disposed in said washing vessel, wherein said cleaning surface is supported on said surfactant tablet.

17. A brush care system comprising:

a washing vessel having one or more liquid-holding compartments and an upper edge, said one or more liquid-holding compartments for washing brushes, a cleaning surface including an irregular brush cleaning surface against which a brush may be agitated for cleaning, said cleaning surface removably disposed in one of said one or more compartments, said cleaning surface having a removal handle extending perpendicularly from said cleaning surface to facilitate removal of said cleaning surface from one of said one or more compartments, and a drying vessel for retaining drying brushes, said drying vessel having an upper rim and one or more upstanding walls, said one or more upstanding walls including one or more apertures for ventilating said drying vessel, the upper rim of said drying vessel detachably securable to the upper edge of said washing vessel to form an assembly, wherein said cleaning surface is enclosed in said assembly;

and a surfactant tablet disposed in said washing vessel, wherein said cleaning surface is supported on said surfactant tablet.

* * * * *